US008102125B2

(12) United States Patent
Bucci

(10) Patent No.: US 8,102,125 B2
(45) Date of Patent: Jan. 24, 2012

(54) APPARATUS AND METHODS FOR REDUCING THE POWER CONSUMPTION OF FLUORESCENT LIGHTS

(75) Inventor: George Bucci, Southington, CT (US)

(73) Assignee: Pyramid Technologies LLC, Meriden, CT (US)

( * ) Notice: Subject to any disclaimer, the term of this patent is extended or adjusted under 35 U.S.C. 154(b) by 259 days.

(21) Appl. No.: 12/593,393

(22) PCT Filed: Mar. 27, 2008

(86) PCT No.: PCT/US2008/004022

§ 371 (c)(1), (2), (4) Date: Sep. 28, 2009

(87) PCT Pub. No.: WO2008/121309

PCT Pub. Date: Oct. 9, 2008

(65) Prior Publication Data

US 2010/0109565 A1 May 6, 2010

Related U.S. Application Data

(60) Provisional application No. 60/920,917, filed on Mar. 20, 2007.

(51) Int. Cl.
*H05B 41/24* (2006.01)

(52) U.S. Cl. ..... 315/146; 315/209 R; 315/293; 315/299; 315/360

(58) Field of Classification Search ..... 315/137, 315/146, 209 R, 210, 291, 293, 299, 360
See application file for complete search history.

(56) References Cited

U.S. PATENT DOCUMENTS

| | | | | |
|---|---|---|---|---|
| 4,219,759 | A * | 8/1980 | Hirschfeld | 315/146 |
| 5,182,464 | A * | 1/1993 | Woodworth et al. | 307/87 |
| 5,469,028 | A | 11/1995 | Nilssen | |
| 6,172,489 | B1 | 1/2001 | Walker | |
| 6,842,668 | B2 * | 1/2005 | Carson et al. | 700/286 |
| 6,906,476 | B1 * | 6/2005 | Beatenbough et al. | 315/276 |
| 6,995,481 | B2 * | 2/2006 | Gibson | 307/96 |
| 2004/0119448 | A1 | 6/2004 | Wiegand et al. | |

* cited by examiner

*Primary Examiner* — Thuy Vinh Tran
(74) *Attorney, Agent, or Firm* — Maurice M. Klee

(57) ABSTRACT

Systems for reducing the power consumption of fluorescent lights are provided. The systems can be used in new construction as well as retrofitted into existing buildings employing overdriven fluorescent lights without significantly affecting the operation of utility power lines. In preferred embodiments, the systems provide substantially constant light output during start-up and low voltage conditions.

27 Claims, 7 Drawing Sheets

APPARATUS AND METHODS FOR REDUCING THE POWER CONSUMPTION OF FLUORESCENT LIGHTS

CROSS REFERENCE TO RELATED APPLICATIONS

This application is the U.S. national phase under 35 U.S.C. §371 of International Application No. PCT/US2008/004022, filed Mar. 27, 2008, which was published in English under PCT Article 21(2) on Oct. 9, 2008 as International Publication No. WO 2008/121309. This application claims the benefit under 35 U.S.C. §119(e) of U.S. Provisional Application No. 60/920917, filed Mar. 30, 2007, the contents of which in its entirety is hereby incorporated by reference.

FIELD OF THE INVENTION

This invention relates to energy conservation and, in particular, to energy conservation through reduction in the power consumption of fluorescent lights.

BACKGROUND OF THE INVENTION

Fluorescent lights are the most common light source used in commercial buildings. As is well known, to provide the same amount of light output, a fluorescent bulb requires more electrical power when cold than after it has heated up. Once heated up, the extra power provided during start-up is dissipated as heat and does not substantially affect the light output of the bulb as perceived by the user. Indeed, the extra power has the advantage that the light output from the bulb does not perceptibly decrease when the line voltage drops, as, for example, when a large piece of electrical equipment such as an air-conditioner compressor comes on-line.

As a result of these considerations, the manufacturers of fluorescent lighting have historically used ballasts whose effective impedance, whether provided by electrical components (resistors, capacitors and/or inductors) or by electronic circuits, has been selected so that the fluorescent bulb is always operated in an overpowered condition. This overpowering has been substantial, with power consumption typically running 20-30% higher than that actually required to operate a warmed-up fluorescent bulb. Recently, energy efficient fluorescent bulbs have been introduced to the market. These bulbs consume less energy but take substantial periods of time before they reach full light output. Also, these energy efficient bulbs come with their own ballasts and thus do not address the problem of the installed base of existing fluorescent fixtures with ballasts designed for overpowering.

The need to reduce the electrical power consumed by lighting has become especially acute in older buildings whose electrical systems were designed at the time when the use of electronic equipment, e.g., computers, was less prevalent or substantially non-existent. In many of these buildings, it is physically impossible to feed more power to the building, especially in the case of older skyscrapers where the electrical conduits running up the center of the building are already filled to capacity. The situation has become so severe in some older buildings that entire floors cannot be used because of insufficient power to both light the floor and provide users with the electricity needed in a modern office.

Some efforts have been made to address the power consumption problem by installing fixed phase SCRs in the power lines leading to fluorescent light fixtures. In practice, these approaches have proved unacceptable to consumers because of (1) low output from the fluorescent lights during start-up and (2) reduced light output under low voltage conditions. That is, these approaches have simply re-introduced the problems which led to overpowering in the first place. Moreover, switching of the SCRs leads to unacceptable levels of noise (e.g., harmonic distortion) on utility power lines, as well as power factor issues. For large buildings, the electrical noise/power factor problems can reach levels where power companies often seek premium rates for their power, thus reducing the consumer's economic incentive to reduce power consumption.

There thus exists a need in the industry for improved systems for reducing the power consumption of fluorescent lights. In particular, there exists a need for improved systems that can be readily retrofitted into existing buildings employing overdriven fluorescent lights without reintroducing start-up and low voltage problems and without significantly affecting the operation of utility power lines. The present invention, in its preferred embodiments, addresses and solves these existing problems in this field.

SUMMARY OF THE INVENTION

In accordance with a first aspect, the invention provides apparatus for controlling the delivery of electrical power (e.g., 9-P1) to fluorescent light fixtures (15), said electrical power having a phase which has a substantially sinusoidal waveform which has repetitive zero crossings separated from one another by a nominal time period T, said apparatus comprising:

(a) a plurality of controllers (23-1, 23-2, 23-*j*, 23-N); and (b) a plurality of electronic switches (e.g., the 25-P1 switches for the phase 1 power);

wherein during use of the apparatus:

(i) each electronic switch (e.g., the 25-P1 switch associated with the 23-*j* controller where "j" is used here and throughout the specification and claims to indicate any of the controllers) is in series with at least one fluorescent light fixture (15);

(ii) each electronic switch (e.g., the 25-P1 switch associated with the 23-*j* controller) is operatively connected to a controller (e.g., 23-*j*) that sends an electronic signal to the switch to cause the switch to transition between non-conducting and conducting states, said electronic signal being sent during each half cycle of the phase's waveform at a switching time t(j) measured from the waveform's zero crossing, where j indicates the controller sending the electronic signal and where $0 \leqq t(j) \leqq T$ for each j; and (iii) for at least two of the controllers $j_1, j_2$, on at least a statistical basis, $t(j_1) \neq t(j_2)$.

As used herein, two times are not equal on at least a statistical basis if: (i) the times are preset to have a fixed difference, or (ii) at least one of the times varies randomly so as not to be equal to the other time except on an infrequent (substantially random) basis, or (iii) a combination of (i) and (ii).

In accordance with a second aspect, the invention provides an assembly (e.g., 22-*j*) for controlling the delivery of electrical power to one or more fluorescent light fixtures (15), said one or more fluorescent light fixtures being on the same phase (e.g., 9-P1) of the electrical power and the electric power of said phase having a substantially sinusoidal waveform which has repetitive zero crossings separated from one another by a nominal time period T, said assembly comprising:

(a) an electronic switch (e.g., the 25-P1 switch associated with the 23-*j* controller) which during use is in series with the one or more fluorescent light fixtures (15), and (b) a controller (23-*j*) which during use is operatively connected to the electronic switch (e.g., the 25-P1 switch associated with the 23-*j* controller) for sending an electronic signal to the switch to cause the switch to transition between non-conducting and conducting states;

wherein:

(i) the electronic signal of the controller (23-*j*) is repetitively sent to the electronic switch during each half cycle of the waveform at a switching time t measured from the zero crossing; and (ii) t satisfies the relationship:

$$t=t_{nom}+t_{var}$$

where $t_{nom}$ is a nominal value for the switching time and $t_{var}$ has a magnitude and/or sign that varies with time so as to modulate $t_{nom}$.

In accordance with a third aspect, the invention provides an assembly (e.g., 22-*j*) for controlling the delivery of electrical power to one or more fluorescent light fixtures (15), said one or more fluorescent light fixtures being on the same phase (e.g., 9-P1) of the electrical power and the electric power of said phase having a substantially sinusoidal waveform which has repetitive zero crossings separated from one another by a nominal time period T, said assembly comprising:

(a) an electronic switch (e.g., the 25-P1 switch associated with the 23-*j* controller) which during use is in series with the one or more fluorescent light fixtures, and (b) a controller (23-*j*) which during use is operatively connected to the electronic switch (e.g., the 25-P1 switch associated with the 23-*j* controller) for sending an electronic signal to the switch to cause the switch to transition between non-conducting and conducting states;

wherein:

(i) the electronic signal of the controller is repetitively sent to the electronic switch during each half cycle of the waveform at a switching time t measured from the zero crossing; and (ii) t has a mean value during steady state $t_{mean-ss}$ and a mean value during start-up $t_{mean-start}$, where:

$$t_{mean-start}<t_{mean-ss}.$$

In accordance with a fourth aspect, the invention provides an assembly for controlling the delivery of electrical power to one or more fluorescent light fixtures, said one or more fluorescent light fixtures being on the same phase (e.g., 9-P1) of the electrical power and the electric power of said phase having a substantially sinusoidal waveform which has repetitive zero crossings separated from one another by a nominal time period T, said assembly comprising:

(a) an electronic switch (e.g., the 25-P1 switch associated with the 23-*j* controller) which during use is in series with the one or more fluorescent light fixtures, and (b) a controller (23-*j*) which during use is operatively connected to the electronic switch (e.g., the 25-P1 switch associated with the 23-*j* controller) for sending an electronic signal to the switch to cause the switch to transition between non-conducting and conducting states;

wherein:

(i) the electronic signal of the controller is repetitively sent to the electronic switch during each half cycle of the waveform at a switching time t measured from the zero crossing; and (ii) t has a mean value during steady state $t_{mean-ss}$ and at least one mean value during low voltage conditions $t_{mean-lowvolt}$, where:

$$t_{mean-lowvolt}<t_{mean-ss}.$$

The reference symbols used in the above summary of the invention are only for the convenience of the reader and are not intended to and should not be interpreted as limiting the scope of the invention. More generally, it is to be understood that both the foregoing general description and the following detailed description are merely exemplary of the invention, and are intended to provide an overview or framework for understanding the nature and character of the invention as it is claimed.

Additional features and advantages of the invention are set forth in the detailed description which follows, and in part will be readily apparent to those skilled in the art from that description or recognized by practicing the invention as described herein. Both these additional aspects of the invention and those discussed above can be used separately or in any and all combinations.

The accompanying drawings are included to provide a further understanding of the invention, and are incorporated in and constitute a part of this specification. The drawings illustrate various embodiments of the invention, and together with the description serve to explain the principles and operation of the invention. In the drawings and the specification, like parts in related figures are identified by like reference symbols.

BRIEF DESCRIPTION OF THE DRAWINGS

FIGS. 4-6 are not drawn to scale but have been deliberately exaggerated to illustrate the effects of transients caused by the closing of electronic switches.

Figure 1:
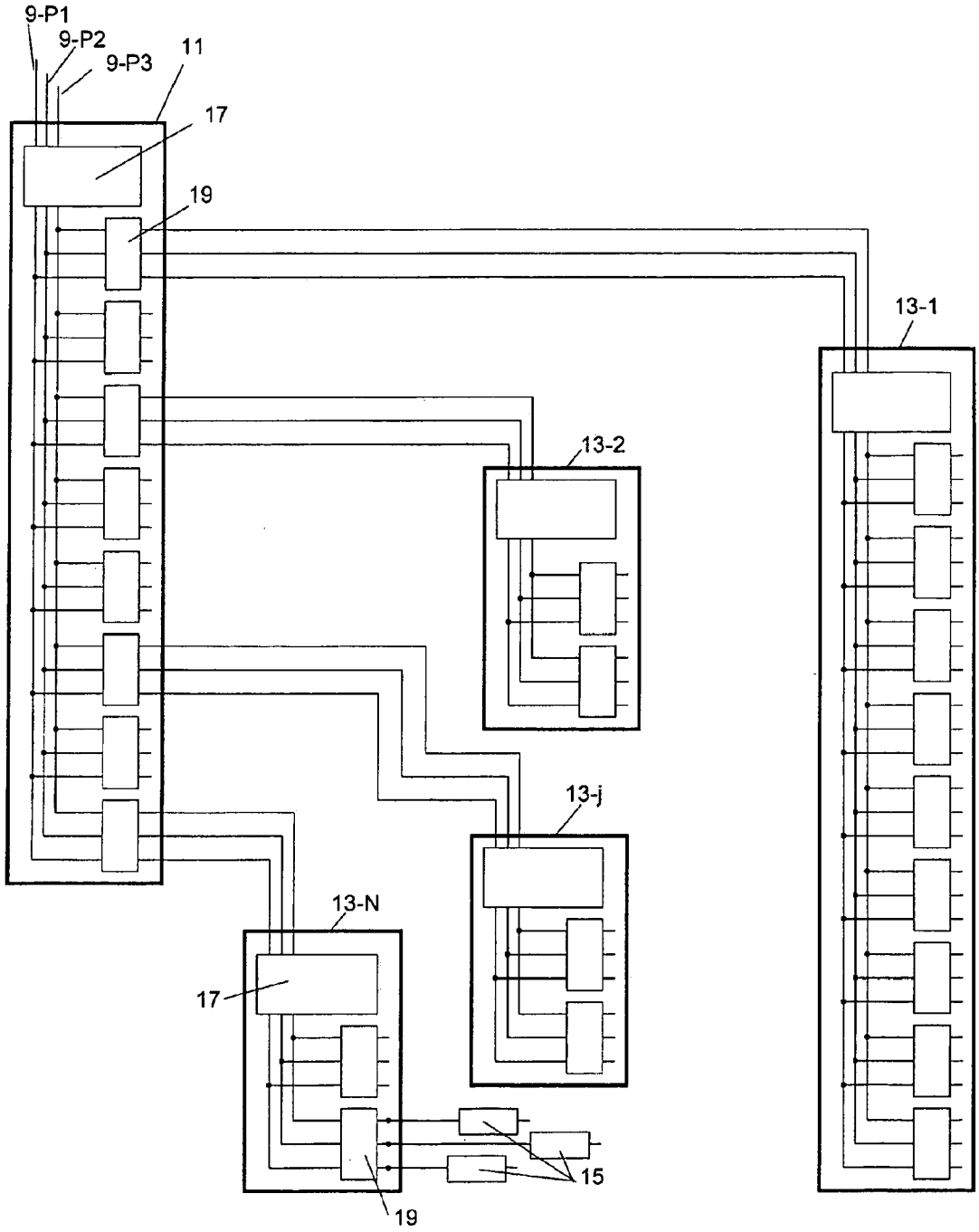
FIG. 1 is a schematic diagram illustrating the manner in which 3-phase power is provided to fluorescent light fixtures in a representative commercial establishment.

The reference symbols used in the figures correspond to the following:

9-P1 phase 1 power feed
9-P2 phase 2 power feed
9-P3 phase 3 power feed
11 main power panel
13-1 lighting panel 1
13-2 lighting panel 2
13-*j* lighting panel j
13-N lighting panel N
15 fluorescent light fixtures
17 main circuit breaker
19 branch circuit breaker
21 master controller
22-1 controller assembly 1
22-2 controller assembly 2
22-*j* controller assembly j
22-N controller assembly N
23-1 controller 1
23-2 controller 2
23-*j* controller j
23-N controller N
25-P1 electronic switch on phase 1
25-P2 electronic switch on phase 2
25-P3 electronic switch on phase 3
27 SCR1
29 SCR2
31-P1 controller phase 1 power in
31-P2 controller phase 2 power in
31-P3 controller phase 3 power in
33-P1 controller phase 1 power out
33-P2 controller phase 2 power out
33-P3 controller phase 3 power out
43-1 input to controller 1 from master controller
43-2 input to controller 2 from master controller
43-*j* input to controller j from master controller
43-N input to controller N from master controller
45-P1 phase comparator on phase 1
45-P2 phase comparator on phase 2
45-P3 phase comparator on phase 3
47 microprocessor assembly
49 SCR driver assembly

DETAILED DESCRIPTION OF THE INVENTION AND ITS PREFERRED EMBODIMENTS

FIG. 1 shows the overall layout of a representative, prior art, electrical distribution system used in a commercial establishment for fluorescent lighting. Three phase power 9-P1, 9-P2, 9-P3 feeds a main or sub-main panel 11, which feeds one or more lighting panels 13 (e.g., 13-1, 13-2, 13-*j*, and 13-N), each of which is attached to one or more fluorescent light fixtures or one or more banks of fixtures 15. As is conventional, each panel, whether it is a main, sub-main, or lighting panel, may include a main circuit breaker 17 and will include one or more branch breakers 19. Depending on the size of the building, main panels, sub-main panels (if used), and lighting panels can be distributed throughout the building, including on different floors or at multiple locations on a single floor, or may be at a single location for smaller establishments.

For purposes of illustration, only four lighting panels 13 are shown in FIG. 1 and substantially reduced numbers of branched circuits are shown for the individual panels. Similarly, in this figure, fluorescent light fixtures 15 are shown only for one branch of one lighting panel, it being understood that in practice, each branch will normally be connected to one or more fixtures. The lighting panels have been identified using conventional mathematical notation by the numbers 1, 2, j, and N to indicate that there are 1 . . . N panels, with an arbitrary panel being indicated by the letter j. These same simplifications and numbering system is used in FIG. 2.

Figure 2:
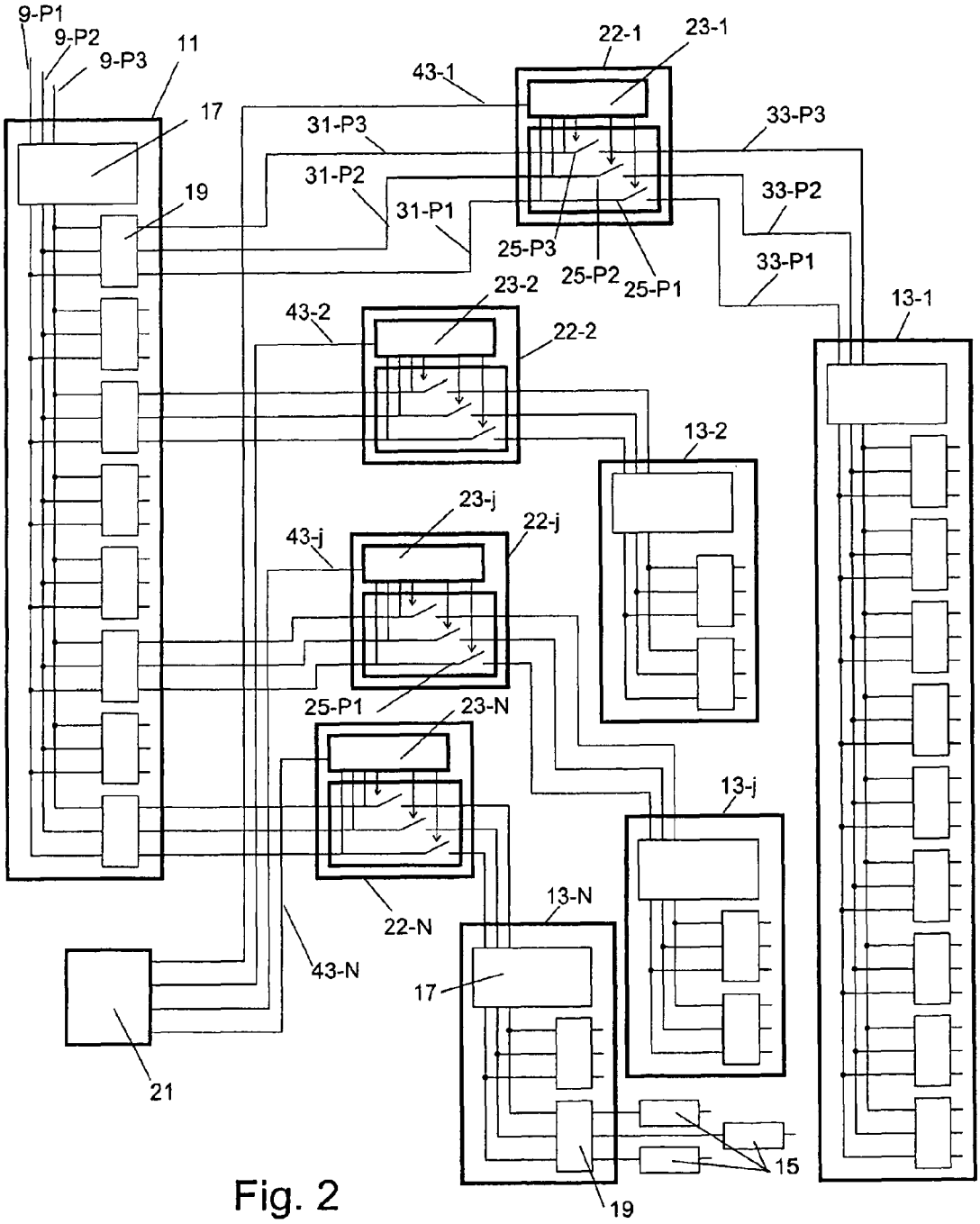
FIG. 2 is a schematic diagram illustrating the application of a preferred embodiment of the present invention to the power distribution system of FIG. 1.

FIG. 2 shows a representative electrical distribution system for a commercial establishment for fluorescent lighting constructed in accordance with a preferred embodiment of the present invention. As shown in this figure, controller assemblies 22-1, 22-2, 22-*j*, and 22-N have been inserted between main power panel 11 and lighting panels 13-1, 13-2, 13-*j*, and 13-N, respectively. Controller assemblies 22-1, 22-2, 22-*j*, and 22-N comprise controllers 23-1, 23-2, 23-*j*, and 23-N, respectively, each of the controllers being operatively connected to three electronic switches 25-P1, 25-P2, and 25-P3, which are inserted in the phase 1, phase 2, and phase 3 power lines leading to the associated lighting panel 13. Controller assemblies 22-1, 22-2, 22-*j*, and 22-N and controllers 23-1, 23-2, 23-*j*, and 23-N are also referred to herein as "local controller assemblies" and "local controllers", respectively.

Figure 3:
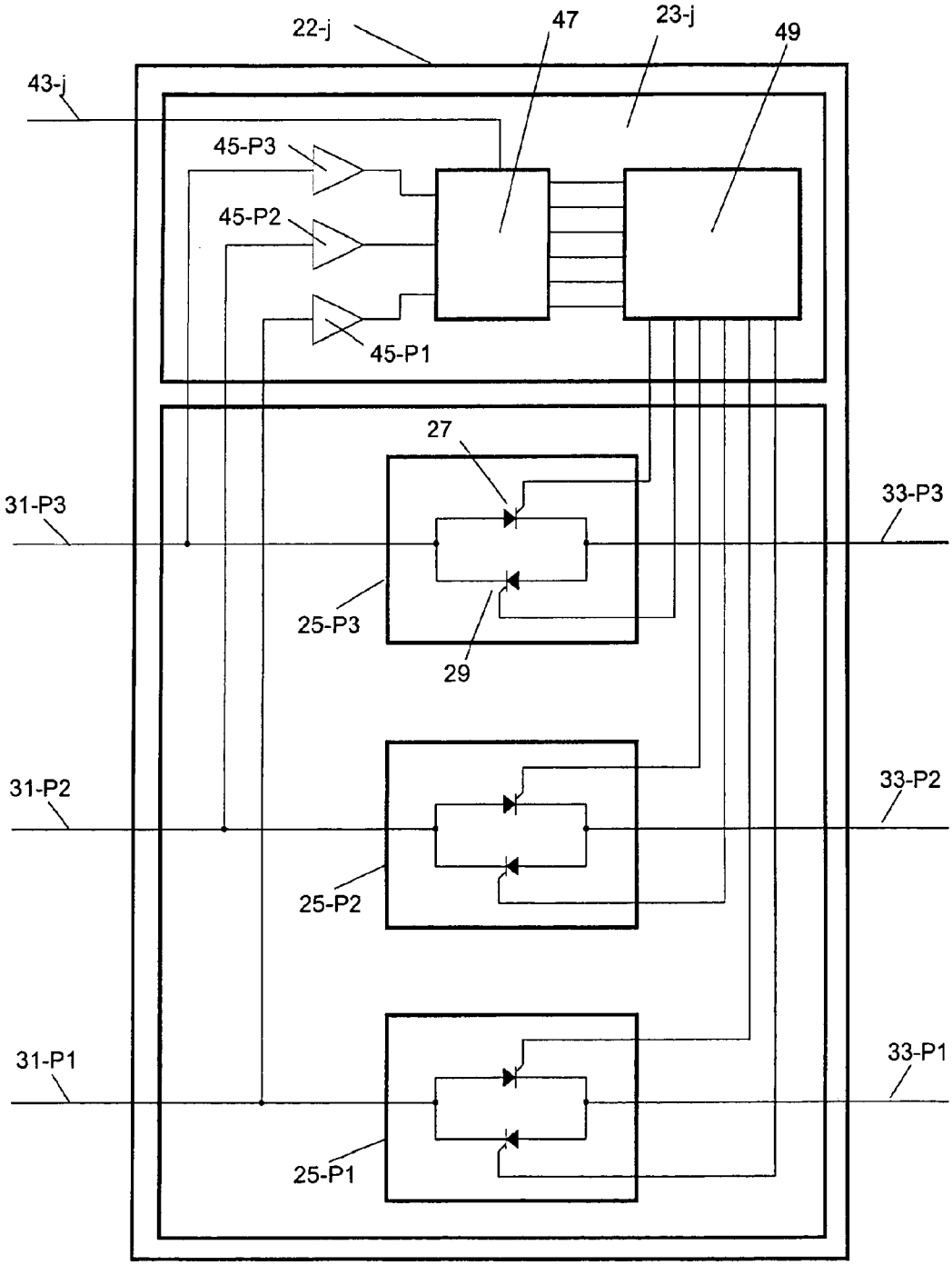
FIG. 3 is a schematic diagram illustrating a preferred controller and preferred electronic switch for use in the power distribution system of FIG. 2. Specifically, this figure illustrates the "$j^{th}$" controller and the "$j^{th}$" electronic switch, it being understood that in practice, preferably all of the controllers and electronic switches employed in any particular application of the invention will have the same structure.

FIG. 3 shows a representative structure for one of the controller assemblies of FIG. 2, specifically, the jth controller assembly 22-*j*. As shown in this figure, 3-phase power enters the assembly on conductors 31-P1, 31-P2, and 31-P3, and leaves the assembly on conductors 33-P1, 33-P2, and 33-P3. To reduce power consumption of the fluorescent fixtures, the power is switched within the assembly by switches 25-P1, 25-P2, and 25-P3 for phases 1, 2, and 3, respectively. As shown in FIG. 3, a preferred construction for the switches constitutes two SCR's 27,29 in a back-to-back configuration. Other electronic switch types can be used if desired, e.g., IGBT's, Triacs, and the like. The switch, of course, needs to be sized to handle the power load being delivered to the lighting panel.

The controller portion 23-*j* of controller assembly 22-j comprises: (i) phase comparators 45-P1, 45-P2, and 45-P3, (ii) microprocessor assembly 47, and (iii) power driver assembly 49. The phase comparators sample the voltage on the input power conductors and determine the zero crossing point for each of the three phases. The microprocessor assembly, which comprises a conventional microprocessor or DSP and associated electronics, uses the inputs from the phase comparators and the input from master controller 21 provided on conductor 43-*j* to determine a switching time for each of electronic switches 25-P1, 25-P2, and 25-P3.

In the most preferred embodiments of the invention, the switching time t(j) for at least one of the phases is given by:

$$t(j)=t_{nom}(j)+t_{var}(j)$$

where:

(a) $t_{nom}$(j) is a nominal value for t(j) provided by the master controller (note that the master controller does not need to be connected continually to the local controllers, but can upload data to the local controllers which is stored locally and used when appropriate, e.g., at different times of the day to, for example, shut down some or all of the fluorescent light fixtures associated with the local controller to save power; in such a case, the master controller does not need to be resident at the commercial establishment but can be brought to the establishment for initial set-up and subsequent modifications if needed; as a further alternative, the master controller can be completely off-site either during initial set-up and/or at the time of modification and can communicate with the local controllers by a modem, the internet, or other methods for remote communication);

(b) $t_{nom}(j)$ satisfies the relationship:

$0 \leqq t_{nom}(j) \leqq T$, where T is the nominal time period between zero crossings, i.e., 8.33 milliseconds for 60 hertz power (note that when the master controller sets $t_{nom}(j) \approx T$, in certain embodiments of the invention, the local controller is preferably programmed to cease firing the SCR's so as to completely shut off the associated fluorescent light fixtures, thus drawing no power); and (c) $t_{var}(j)$ is provided by the local controller and has a magnitude and/or sign that varies with time so as to modulate $t_{nom}(j)$.

The switching times for the remaining two phases are also preferably controlled in the same manner, but need not have the same $t_{nom}(j)$'s and/or $t_{var}(j)$'s. In general, the $t_{nom}(j)$'s and $t_{var}(j)$'s for a given local controller will be similar for the three phases assuming that the type of fluorescent light fixtures and desired power reductions on each phase are similar. However, if different types of fluorescent light fixture ballasts are used on different phases for a given local controller, then $t_{nom}(j)$ is preferably adjusted for each phase to accommodate the particular type of ballast locally associated with the phase to achieve the desired reduction in power consumption for that phase.

Typically, in a given facility, all of the lighting ballasts are from a single manufacturer and there is a desire by the consumer to achieve the same amount of power savings across the facility for a given time of day on all lighting fixtures. This means that the apparent optimal $t_{nom}(j)$'s will all end up being identical. Such identical $t_{nom}(j)$'s lead to serious harmonic distortions on the power line. In accordance with the invention, this problem is addressed by adjusting the $t_{nom}(j)$'s for at least one phase (preferably for each of the phases) so that the $t_{nom}(j)$'s are not substantially coincident on the same phase.

Figure 4:
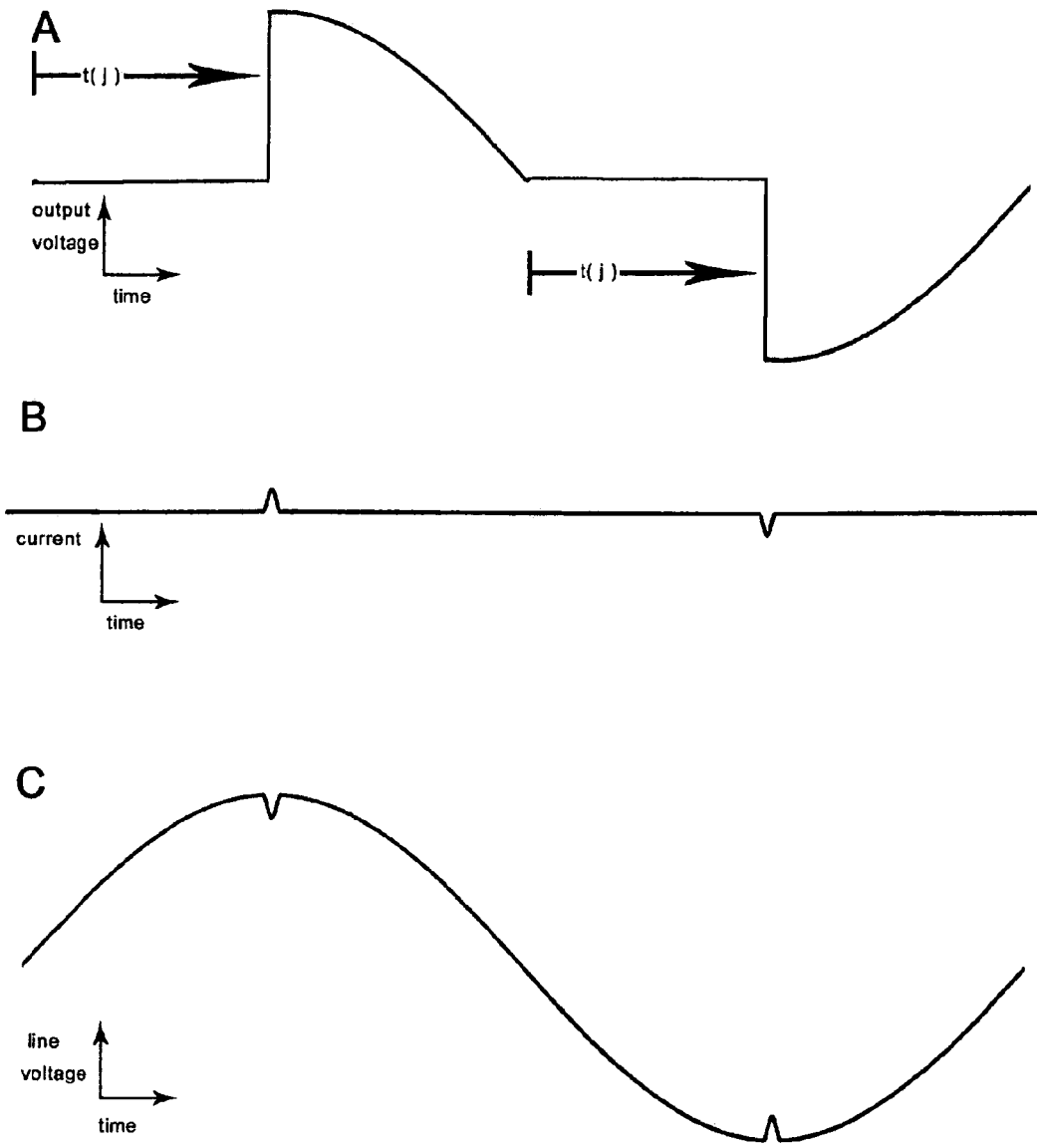
FIG. 4 illustrates the effects on load (FIG. 4A), current (FIG. 4B), and line voltage (FIG. 4C) of a transition between non-conducting and conducting states of a single electronic switch which operates in one phase of a 3-phase power system.
Figure 5:
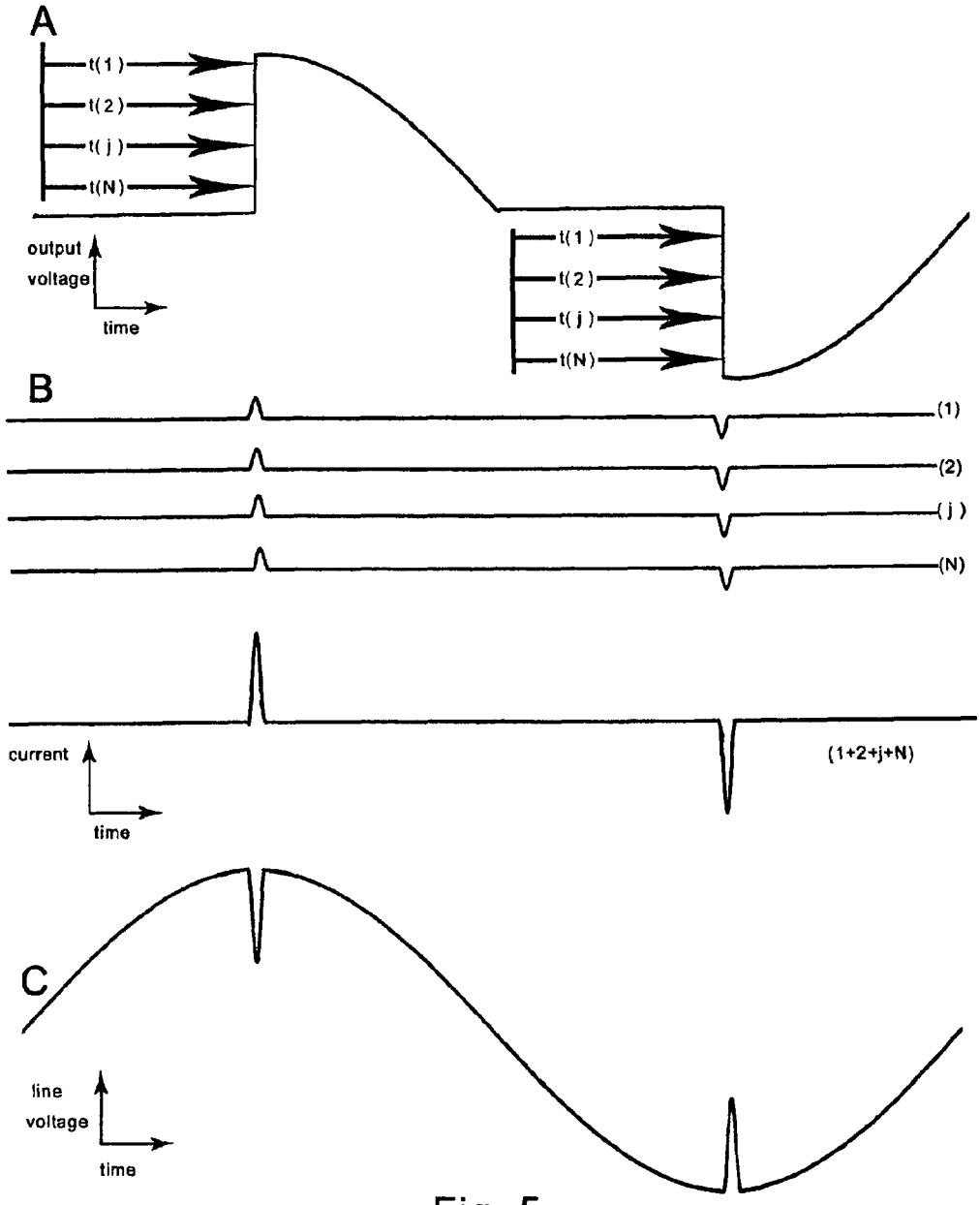
FIG. 5 illustrates the effects on load (FIG. 5A), current (FIG. 5B), and line voltage (FIG. 5C) of transitions between non-conducting and conducting states of four electronic switches which operate in one phase of a 3-phase power system, where the four electronic switches switch at the same time. To facilitate the explanation of the invention, the switching times and current traces are identified as 1, 2, j, and N, i.e., they are identified with the nomenclature used in FIG. 2 to identify controllers.
Figure 6:
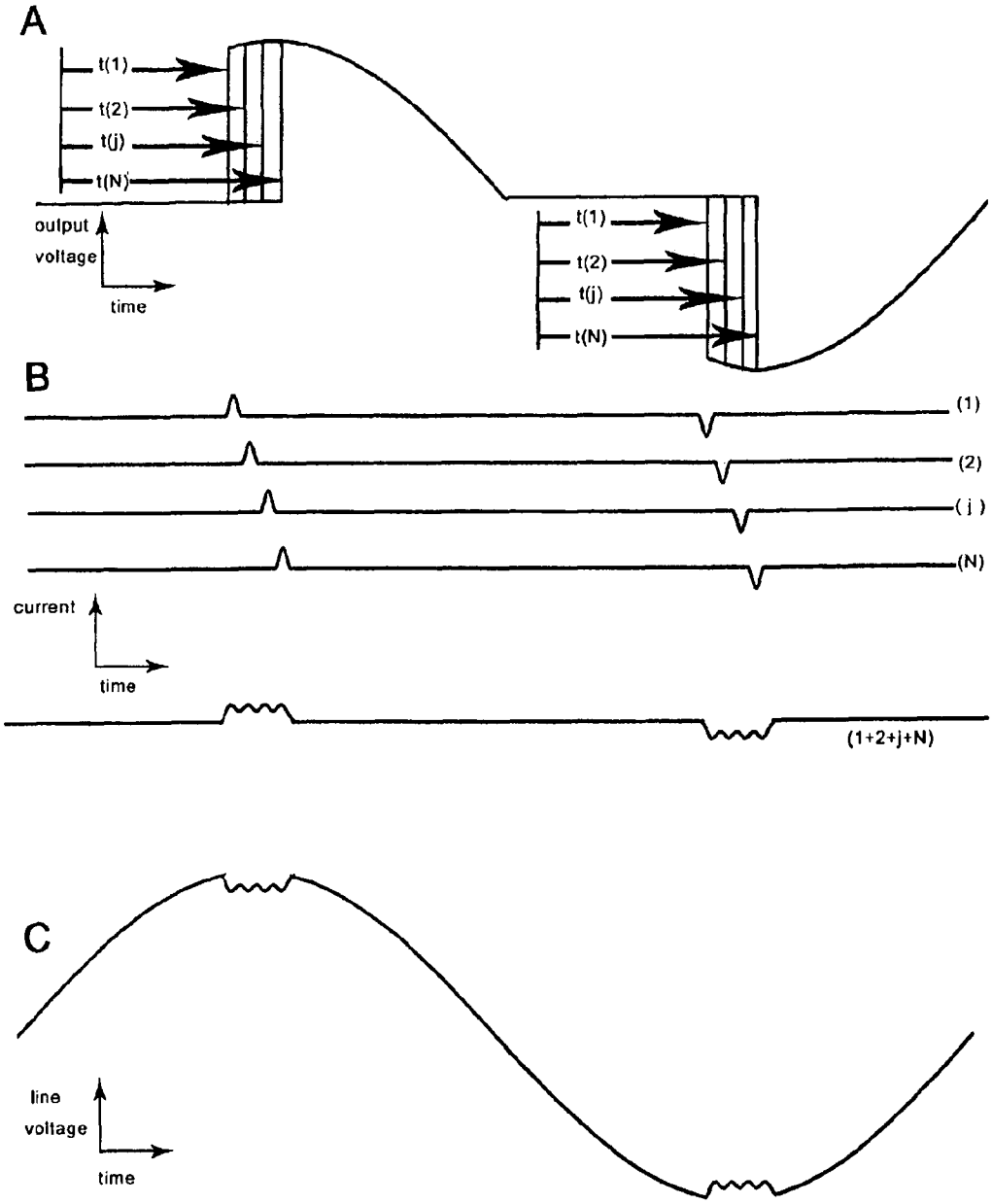
FIG. 6 illustrates the effects on load (FIG. 6A), current (FIG. 6B), and line voltage (FIG. 6C) of transitions between non-conducting and conducting states of four electronic switches which operate in one phase of a 3-phase power system, where the four electronic switches switch at staggered times. As in FIG. 5, the switching times and current traces use the same nomenclature as used in FIG. 2 to identify controllers and thus are identified as 1, 2, j, and N.

FIGS. 4-6 illustrate the effect of using coincident and non-coincident $t_{nom}(j)$'s or, more generally, t(j)'s. FIG. 4 shows the effects on output voltage (e.g., voltage on 33-P1), current, and input (line) voltage (e.g., voltage on 31-P1) for one controller causing one electronic switch to transition between its non-conducting and conducting states. As can be seen in FIG. 4A, the output voltage is zero until t(j) so as to provide the desired power savings. The off state is sufficiently short that the fluorescent lights do not exhibit flicker or dimming.

At t(j), the electronic switch rapidly changes from an off state to an on state, causing a current transient. This current transient is shown in FIG. 4B and produces a voltage transient on the input line shown in FIG. 4C. These transients potentially cause resonances and harmonics in the power system. These resonances and harmonics can be localized to a single facility or can spread to the power grid.

The transients associated with a single switch generally do not have a large enough magnitude to be a problem. However, the magnitude of the transients grow linearly with the number of electronic switches on a given phase. In large commercial establishments, the number of lighting panels per phase can easily be 10 and in some cases larger than 100.

The effect of multiple electronic switches on a single phase is shown in FIG. 5. For purposes of illustration, four electronic switches are shown each having the same switching time and same lighting load. With four switches closing simultaneously, the current transients add, producing current and voltage transients that are four times larger than that produced by the closing of a single electronic switch. See FIGS. 5B and 5C.

FIG. 6 illustrates the solution to this problem provided by the present invention. FIG. 6A illustrates the output waveforms of four overlaid electronic switches where the switching times of the switches are staggered. As can be seen in FIGS. 6B and 6C, the current and voltage transients are equal in magnitude to those associated with a single electronic switch (see FIG. 4).

Importantly, the stagger between the switching times can be quite small so that numerous electronic switches on a single phase can be accommodated. For example, depending on the type of lighting fixtures used in a particular facility, the difference between switching times can be as small as one microsecond. Thus, 100 or more switches on a single phase can be readily accommodated.

The switching times can be staggered in a number of ways. For example, each controller assembly can be assigned a fixed $t_{nom}(j)$, with at least two of the $t_{nom}(j)$'s being different from one another and, preferably, with all of the $t_{nom}(j)$'s being different from one another. Alternatively, all or some of the $t_{nom}(j)$'s can purposely be the same and a variable time $t_{var}(j)$, which is preferably random, can be added to the individual $t_{nom}(j)$'s. This addition of t (i) preferably takes place at the level of the local controllers using a digital random number generator. Most preferably, the assigned $t_{nom}(j)$'s are different and a random $t_{var}(j)$ is added at the local controller level. In this way, the switching energy is spread as evenly as possible and thus further reduces the adverse effects of switching transients. Preferably, the $t_{var}(j)$'s satisfy the relationship:

$$0.002 \cdot T \leqq |t_{var}(j)| \leqq 0.06 \cdot T.$$

In this way, both low capacitance and high capacitance ballasts can be accommodated.

The $t_{nom}(j)$'s and the $t_{var}(j)$'s also preferably satisfy the following relationship for at least two of the local controllers and, most preferably, all of the local controllers:

$$|t_{nom}(j_i) - t_{nom}(j_k)| > \max(|t_{var}(j_i)|, |t_{var}(j_k)|).$$

In this way, overlap between the t(j)'s is minimized or completely avoided as the $t_{var}(j)$'s vary, e.g., randomly.

As discussed above, fluorescent lights produce less light output when they are first started. To address this problem, in certain preferred embodiments, the local controllers move $t_{nom}(j)$ towards zero to produce full light output at startup. In particular, $t_{nom}(j)$ preferably has a start-up value $t_{nom\text{-}start}(j)$ and a steady state value $t_{nom\text{-}ss}(j)$ where:

$$t_{nom\text{-}start}(j) < t_{nom\text{-}ss}(j).$$

For any given controller, this means that the switching time t generated by the controller will have a mean value during steady state $t_{mean\text{-}ss}$ and a mean value during start-up $t_{mean\text{-}start}$ which preferably satisfy the relationship:

$$t_{mean\text{-}start} < t_{mean\text{-}ss}.$$

As also discussed above, fluorescent lights tend to dim when large loads come on line. Accordingly, in other preferred embodiments, the local controllers move $t_{nom}(j)$ towards zero when a low line voltage is detected. In particular, $t_{nom}(_1)$ preferably has at least one low-voltage value $t_{nom\text{-}lowvolt}(j)$ and a steady state value $t_{nom\text{-}ss}(j)$ where:

$$t_{nom\text{-}lowvolt}(j) < t_{nom\text{-}ss}(j).$$

For any given controller, this means that the switching time t generated by the controller will have a mean value during steady state $t_{mean\text{-}ss}$ and at least one mean value during low voltage conditions $t_{mean\text{-}lowvolt}$ which preferably satisfy the relationship:

$$t_{mean\text{-}lowvolt} < t_{mean\text{-}ss}.$$

Figure 7:
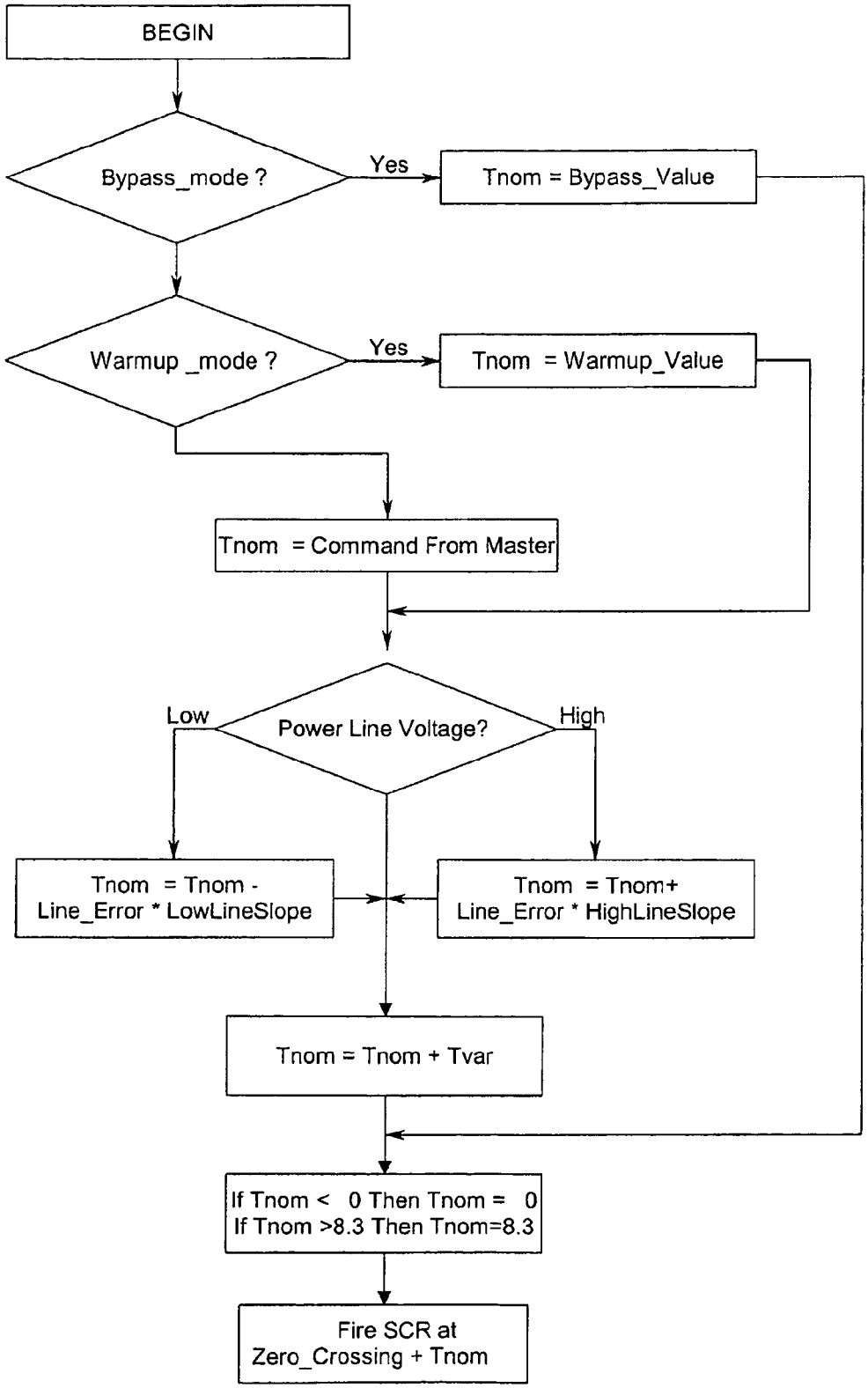
FIG. 7 is a flow chart showing representative microprocessor logic for operating modes of an individual controller of FIG. 2.

FIG. 7 is a flow chart for the operation of a local controller illustrating switching of the controller between different modes. In particular, the figure shows a warm up mode during which $t_{nom}=t_{nom\text{-}start}(j)<t_{nom\text{-}ss}(j)$ and a low voltage mode during which $t_{nom}=t_{nom\text{-}lowvolt}(j)<t_{nom\text{-}ss}(j)$. The figure also shows a high voltage mode during which $t_{nom}$ can be made longer to protect the fluorescent fixture from high line conditions. The low and high voltage modes are effectuated by the amount of line error times a correction constant (the LowLineSlope and the HighLineSlope) which is determined empirically for a given fluorescent fixture by simulating high and low voltage conditions using, for example, a Variac in a laboratory setting.

In addition to the above modes, FIG. 7 also shows a mode referred to as a "bypass mode." This mode is used during installation of the system to aid in characterization of the fluorescent lighting ballasts. While in this mode, $t_{nom}(j)$ can be varied manually to find the point where the particular fluorescent fixture should be operated to achieve maximum power conservation with minimal or no light loss and no flicker. Preferably, this mode self extinguishes after a set time period, e.g., five minutes with no manual adjustment.

Although specific embodiments of the invention have been described and illustrated, it is to be understood that a variety of modifications which do not depart from the scope and spirit of the invention will be evident to persons of ordinary skill in the art from the foregoing disclosure.

For example, the invention has been described in connection with the use of SCR's for the electronic switches, which is a preferred embodiment. As such, the controllers cause the electronic switches to transition from a non-conducting to a conducting state at the t(j)'s. When the conducted current drops to zero, the SCR's automatically turn off. As mentioned above, other types of electronic switches can be used in the practice of the invention. Many of those switches will operate in the same manner as SCR's. However, in some cases, the controller will cause the switch to transition from a non-conducting to a conducting state at a first t(j) and then cause the switch to transition back to the non-conducting state at a second t(j). As used herein and in the claims, the phrase "transition between non-conducting and conducting states" is intended to include both transitions from a non-conducting to a conducting state as well as transitions from a conducting state to a non-conducting state.

Various other modifications will be evident to persons of ordinary skill in the art from the disclosure herein. The following claims are intended to cover the specific embodiments set forth herein as well as such modifications, variations, and equivalents.

What is claimed is:

1. Apparatus for controlling the delivery of electrical power to fluorescent light fixtures, said electrical power having a phase which has a substantially sinusoidal waveform which has repetitive zero crossings separated from one another by a nominal time period T, said apparatus comprising:

(a) a plurality of controllers; and (b) a plurality of electronic switches;

wherein during use of the apparatus:

(i) each electronic switch is in series with at least one fluorescent light fixture;

(ii) each electronic switch is operatively connected to a controller that sends an electronic signal to the switch to cause the switch to transition between non-conducting and conducting states, said electronic signal being sent during each half cycle of the phase's waveform at a switching time t(j) measured from the waveform's zero crossing, where j indicates the controller sending the electronic signal and where $0 \leqq t(j) \leqq T$ for each j; and (iii) for at least two of the controllers $j_1, j_2$, on at least a statistical basis, $t(j_1) \neq t(j_2)$.

2. The apparatus of claim 1 wherein:

(a) the electrical power has a plurality of phases;

(b) each controller is operatively connected to a plurality of electronic switches, one switch for each phase; and (c) during each half cycle of the waveform, each controller sends an electronic signal to each of the switches to which it is connected at switching time t(j).

3. The apparatus of claim 1 wherein, on at least a statistical basis:

$$0.002 \cdot T \leqq |t(j_1)-t(j_2)| \leqq 0.06 \cdot T.$$

4. The apparatus of claim 1 wherein, on at least a statistical basis, $t(j_i) \neq t(j_k)$ for all $j_i \neq j_k$.

5. The apparatus of claim 1 wherein for at least one controller:

$$t(j)=t_{nom}(j)+t_{var}(j)$$

where:

(a) $t_{nom}(j)$ is a nominal value for t(j);

(b) $t_{nom}(j)$ satisfies the relationship:

$$0 \leqq t_{nom}(j) \leqq T; \text{ and}$$

(c) $t_{var}(j)$ has a magnitude and/or sign that varies with time so as to modulate $t_{nom}(j)$.

6. The apparatus of claim 5 wherein $t_{var}(j)$ varies randomly with time.

7. The apparatus of claim 5 wherein $$0.002 \cdot T \leqq |t_{var}(j)| \leqq 0.06 \cdot T.$$

8. The apparatus of claim 5 wherein $t_{nom}(j)$ has a start-up value $t_{nom\text{-}start}(j)$ and a steady state value $t_{nom\text{-}ss}(j)$ where:

$$t_{nom\text{-}start}(j)<t_{nom\text{-}ss}(j).$$

9. The apparatus of claim 5 wherein $t_{nom}(j)$ has at least one low-voltage value $t_{nom\text{-}lowvolt}(j)$ and a steady state value $t_{nom\text{-}ss}(j)$ where:

$$t_{nom\text{-}lowvolt}(j)<t_{nom\text{-}ss}(j).$$

10. The apparatus of claim 1 wherein for each controller:

$$t(j)=t_{nom}(j)+t_{var}(j)$$

where:

(a) for each j, $t_{nom}(j)$ is a nominal value for t(j);

(b) for each j, $0 \leqq t_{nom}(j) \leqq T$; and (c) for each j, $t_{var}(i)$ has a magnitude and/or sign that varies with time so as to modulate $t_{nom}(j)$.

11. The apparatus of claim 10 wherein for each j, $t_{var}(j)$ varies randomly with time.

12. The apparatus of claim 10 wherein for each j:

$$0.002 \cdot T \leqq |t_{var}(j)| \leqq 0.06 \cdot T.$$

13. The apparatus of claim 10 wherein for at least two of the controllers $j_1, j_2$:

$$|t_{nom}(j_1)-t_{nom}(j_2)|>\max(|t_{var}(j_1)|,|t_{var}(j_2)|).$$

14. The apparatus of claim 10 wherein for all $j_i \neq j_k$:

$$|t_{nom}(j_i)-t_{nom}(j_k)|>\max(|t_{var}(j_i)|,|t_{var}(j_k)|).$$

15. The apparatus of claim 10 wherein for each j, $t_{nom}(j)$ has a steady state value $t_{nom\text{-}ss}(j)$ and a start-up value $t_{nom\text{-}start}(j)$ which satisfy the relationship:

$$t_{nom\text{-}start}(j)<t_{nom\text{-}ss}(j).$$

16. The apparatus of claim 10 wherein for each j, $t_{nom}(j)$ has a steady state value $t_{nom\text{-}ss}(j)$ and at least one low-voltage value $t_{nom\text{-}lowvolt}(j)$ which satisfy the relationship:

$$t_{nom\text{-}lowvolt}(j)<t_{nom\text{-}ss}(j).$$

17. The apparatus of claim 10 further comprising a master controller which sets $t_{nom}(j)$ for each j.

18. The apparatus of claim 1 wherein:

(a) each electronic switch comprises two SCRs; and/or (b) each controller is a microprocessor or a DSP.

19. A method of reducing the power load of a building which has at least one central power room from which fluorescent lighting is powered comprising installing the apparatus of claim 1 in said central power room.

20. The method of claim 19 wherein the apparatus is installed in substantially all of the central power rooms of the building from which fluorescent lighting is powered.

21. An assembly for controlling the delivery of electrical power to one or more fluorescent light fixtures, said one or more fluorescent light fixtures being on the same phase of the electrical power and the electric power of said phase having a substantially sinusoidal waveform which has repetitive zero crossings separated from one another by a nominal time period T, said assembly comprising:

(a) an electronic switch which during use is in series with the one or more fluorescent light fixtures, and (b) a controller which during use is operatively connected to the electronic switch for sending an electronic signal to the switch to cause the switch to transition between non-conducting and conducting states;

wherein:

(i) the electronic signal of the controller is repetitively sent to the electronic switch during each half cycle of the waveform at a switching time t measured from the zero crossing; and (ii) t satisfies the relationship:

$$t=t_{nom}+t_{var}$$

where $t_{nom}$ is a nominal value for the switching time and $t_{var}$ has a magnitude and/or sign that varies with time so as to modulate $t_{nom}$.

22. The assembly of claim 21 wherein $t_{var}$ satisfies the relationship:

$$0.002\cdot T\leqq|t_{var}(j)|\leqq 0.06\cdot T.$$

23. The assembly of claim 21 wherein $t_{var}$ varies randomly with time.

24. Apparatus for controlling the delivery of electrical power to fluorescent light fixtures comprising N of the assemblies of claim 21 where:

(i) those assemblies have switching times $t(i)=t_{nom}(i)+t_{var}(i)$, where i=1 . . . . N; and (ii) $t_{nom}(j)$ of one of those assemblies is different from $t_{nom}(k)$ of at least one other of those assemblies.

25. The apparatus of claim 24 where:

$$|t_{nom}(j)-t_{nom}(k)|>\max(|t_{var}(j)|,|t_{var}(k)|).$$

26. An assembly for controlling the delivery of electrical power to one or more fluorescent light fixtures, said one or more fluorescent light fixtures being on the same phase of the electrical power and the electric power of said phase having a substantially sinusoidal waveform which has repetitive zero crossings separated from one another by a nominal time period T, said assembly comprising:

(a) an electronic switch which during use is in series with the one or more fluorescent light fixtures, and (b) a controller which during use is operatively connected to the electronic switch for sending an electronic signal to the switch to cause the switch to transition between non-conducting and conducting states;

wherein:

(i) the electronic signal of the controller is repetitively sent to the electronic switch during each half cycle of the waveform at a switching time t measured from the zero crossing; and (ii) t has a mean value during steady state $t_{mean\text{-}ss}$ and a mean value during start-up $t_{mean\text{-}start}$, where:

$$t_{mean\text{-}start}<t_{mean\text{-}ss}.$$

27. An assembly for controlling the delivery of electrical power to one or more fluorescent light fixtures, said one or more fluorescent light fixtures being on the same phase of the electrical power and the electric power of said phase having a substantially sinusoidal waveform which has repetitive zero crossings separated from one another by a nominal time period T, said assembly comprising:

(a) an electronic switch which during use is in series with the one or more fluorescent light fixtures, and (b) a controller which during use is operatively connected to the electronic switch for sending an electronic signal to the switch to cause the switch to transition between non-conducting and conducting states;

wherein:

(i) the electronic signal of the controller is repetitively sent to the electronic switch during each half cycle of the waveform at a switching time t measured from the zero crossing; and (ii) t has a mean value during steady state $t_{mean\text{-}ss}$ and at least one mean value during low voltage conditions $t_{mean\text{-}lowvolt}$, where:

$$t_{mean\text{-}lowvolt}<t_{mean\text{-}ss}.$$

* * * * *